US006217738B1

(12) United States Patent
O'Driscoll

(10) Patent No.: US 6,217,738 B1
(45) Date of Patent: Apr. 17, 2001

(54) TIN PLATING ELECTROLYTE COMPOSITIONS

(75) Inventor: Cavan Hugh O'Driscoll, Selby (GB)

(73) Assignee: MacDermid, Inc., Waterbury, CT (US)

( * ) Notice: Subject to any disclaimer, the term of this patent is extended or adjusted under 35 U.S.C. 154(b) by 0 days.

(21) Appl. No.: 09/051,784

(22) PCT Filed: Oct. 15, 1996

(86) PCT No.: PCT/GB96/02524

§ 371 Date: Dec. 17, 1998

§ 102(e) Date: Dec. 17, 1998

(87) PCT Pub. No.: WO97/14827

PCT Pub. Date: Apr. 24, 1997

(30) Foreign Application Priority Data

Oct. 17, 1995 (GB) ..... 9521191
Nov. 6, 1995 (GB) ..... 9522673

(51) Int. Cl.[7] ..... C25D 3/32; C25D 7/06; H01B 1/02; C23C 16/00

(52) U.S. Cl. ..... 205/302; 205/140; 252/520.1; 106/1.05

(58) Field of Search ..... 106/1.05; 205/140, 205/302; 252/520.1

(56) References Cited

U.S. PATENT DOCUMENTS 5,174,887 * 12/1992 Federman et al. ..... 205/253

FOREIGN PATENT DOCUMENTS 2 534 279 10/1983 (FR) .

* cited by examiner

*Primary Examiner*—Edna Wong
(74) *Attorney, Agent, or Firm*—Morrison & Foerster

(57) ABSTRACT

There is a disclosed composition suitable for use in a process for electroplating surfaces with tin, comprising: a) one or more acids selected from sulphuric acid, sulphamic acid, aryl sulphonic acids, alkyl sulphonic acids and alkanol sulphonic acids, b) one or more addition agents comprising a mono-, di- or tri-substituted phenol (each optionally alkyoxylated) or a mixture of two or more such compounds, in which at least one of the substituents includes a secondary, tertiary or quaternary nitrogen atom, c) a tin source and d) water. There is also disclosed a method of tin plating using the composition of this invention.

14 Claims, No Drawings

TIN PLATING ELECTROLYTE COMPOSITIONS

This invention relates to electrolyte compositions suitable for electroplating surfaces with tin, e.g., in high speed strip or wire plating processes.

Ideally an electrolyte should possesses the following properties: produce a wide plating range, give a good quality deposit, have low corrosivity, have good conductivity, have good antioxidant properties, have low toxicity and have low environmental impact.

Many electrolyte compositions have been made known and are available in the art. Typical baths include aqueous acidic baths based upon fluoroborate and fluorosilicate electrolytes as described, for example, in U.S. Pat. No. 3,769,182 and U.S. Pat. No. 4,118,289. Aryl sulphonic acids have been used in electroplating baths as disclosed, for example, in U.S. Pat. No. 3,905,878. Traditionally, the aryl sulphonic acid of choice is phenolsulphonic acid as used in the Ferrostan process.

Mineral acid (especially sulphuric acid) electroplating baths have also been described. For example, U.S. Pat. No. 2,156,427 describes a bath containing tar acids and sulphuric acid for producing tin coatings of a fine crystalline texture.

Alkane sulphonic acids containing 1 to 5 carbon atoms in the alkyl group have previously been used in certain electrolytic plating baths and were first disclosed for this use in U.S. Pat. No. 2,522,942. More recently, methanesulphonic acid has been claimed as a specific preferred example of an alkane sulphonic acid in combination with a number of brightening agents for use in the electroplating of tin, lead and tin-lead alloys for example as in U.S. Pat. No. 4,565,610 and U.S. Pat. No. 4,617,097. Systems based on methanesulphonic acid however suffer from high cost, toxicity, odour problems and have been known to introduce surface defects on flow brightened strip steel plate.

Various plating bath compositions comprising an alkane or alkanol sulphonic acid (normally methane sulphonic acid), a tin and/or a lead salt and various auxiliary additives are known. Known auxiliary additives range from smaller organic molecules to large polymeric surfactant molecules and are described in U.S. Pat. No. 4,555,314, U.S. Pat. No. 4,565,609, U.S. Pat. No. 4,582,576, U.S. Pat. No. 4,599,149, U.S. Pat. No. 4,617,097, U.S. Pat. No. 4,666,999, U.S. Pat. No. 4,673,470, U.S. Pat. No. 4,701,244, U.S. Pat. No. 4,828,657 and U.S. Pat. No. 4,849,059.

Plating bath compositions containing mixtures of aryl and alkyl sulphonic acids are also known in the art, for example, as described in EP 0 490 575.

Various addition agents have been proposed which enhance the quality of the tin plate. They can include condensates of hydrophobic organic compounds with alkylene oxides such as, for example, alpha naphthol 6 mol ethoxylate ('ENSA 6' as supplied by Emery-Trylon); alkylbenzene alkoxylates such as the 'Tritons'; derivatives of N-heterocycles such as, for example, 2-alkylimidazolines; aromatic aldehydes such as naphthaldehyde; derivatives of 2,2-bis(4-hydroxyphenyl)propane, for example, as 'Diphone V' (supplied by Yorkshire Chemicals) formed by reacting 2,2-bis(4-hydroxyphenyl) propane with a sulphonating agent; and 2,4,6-substituted phenols in which at least one of the substituents includes a secondary, tertiary or quaternary nitrogen atom as described in U.S. Pat. No. 3,954,573. The latter addition agents have, however only been described for use in fluoroborate tin plating systems.

In the case of strip tinplate manufacture it is desirable from a commercial point of view to have a system capable of giving satisfactory tin deposits over as wide as possible a range of current densities to accommodate all variations in speed of production and minimise the incidence of current density defects.

Accordingly this invention provides a composition suitable for use in a process for electroplating surfaces with tin, which exhibits all the aforementioned benefits of wide plating range, good quality deposits and enhanced environmental benefits.

It comprises:

a) One or more acids selected from sulphuric acid, sulphamic acid, aryl sulphonic acids, alkyl sulphonic acids and alkanol sulphonic acids.

b) One or more addition agents comprising a mono-, di- or tri-substituted phenol (each optionally alkyoxylated) or a mixture of two or more such compounds, in which at least one of the substituents includes a secondary, tertiary or quaternary nitrogen atom. The phenol is preferably a 2,4 or 2,6-disubstituted or 2,4,6-trisubstituted phenol.

c) A tin source.

d) An antioxidant (optional).

e) Water.

Preferably tin source is a tin salt. Alternatively the tin source may be elemental tin.

The acid may be any single acid or combination of acids. Preferred examples of acids include sulphuric acid, sulphamic acid, phenolsulphonic acid, methane sulphonic acid and toluenesulphonic acid.

The acid or acids are present in a total concentration of 25–500 g/l of the composition (with respect to the composition), more preferably 30–250 g/l, even more preferably 30–100 g/l.

The tin source is preferably present in the composition at a concentration of 5–100 g/l (more preferably 15 to 60 g/l) with respect to the composition. Where a tin salt is the tin source it does not have to be a salt of the mono-substituted benzenesulphonic acid or inorganic acid. Thus the composition may contain ions other than tin, sulphonate and those from the inorganic acid. Where the tin source is solid tin, it may be as a tin anode which gradually dissolves as electrolysis proceeds to maintain a substantially constant concentration of tin ions in an electroplating bath. Where the tin source is a tin salt it may be metered to the electroplating bath so that as tin is electro-deposited from the bath, tin salt is added to the bath to maintain the concentration of tin ions in the bath at a constant level.

An antioxidant may optionally be added. These materials retard the oxidation of divalent tin to tetravalent tin which may lead to sludge formation and stannous tin loss. The preferred amount of antioxidant to be added is in the range 1 to 50 g/l of the composition and most preferably from 2.5 to 20 g/l of the composition. Typical antioxidants have been described for example in U.S. Pat. No. 3,749,649 and include 1,2,3-trihydroxybenzene, 1,2-dihydroxybenzene, 1,2-dihydroxybenzene-4-sulphonic acid, 1,2-dihydroxybenzene-3,5-disulphonic acid, 1,4-dihydroxybenzene, 1,4-dihydroxybenzene-2-sulphonic acid, 1,4-dihydroxybenzene-2,5-disulphonic acid or vanadium pentoxide.

The composition of the present invention also comprises one or more addition agents containing a mono-, di- or tri-substituted phenol (each optionally alkoxylated) in which at least one of the substituents includes a secondary, tertiary or quaternary nitrogen atom. The phenols are preferably 2,4 or 2,6-disubstituted or 2,4,6-trisubstituted phenols.

Addition agents have the general formula:

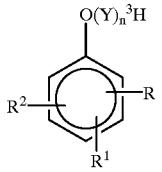

in which:

Y=alkylene, $CH_2CH_2O$ or $CH(CH_3)CH_2O$ $n^3$=0–10

$n^3$=1 when Y=alkylene

R=a group of formula

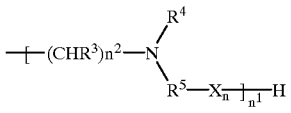

in which:

$R^3$=H, alkyl, aryl, hydroxyl or CHO, with the proviso that when $R^3$ is hydroxyl or CHO, $n^2$=1–3, and when $R^3$ is H, alkyl or aryl, $n^2$ is 1, $R^4$=H, alkyl, cycloalkyl, hydroxyalkyl or alkoxyalkyl $R^5$=alkyl, optionally interrupted by O or N atoms, which may be further substituted, X=a phenol (optionally alkoxylated) radical, optionally further substituted n=0 or 1

$n^1$=1 to 7 when n=0, $n^1$=1 when n=1, $n^1$=1–7

R may optionally be the quaternary ammonium salt formed by reaction with acids such as, sulphuric acid, toluenesulphonic acid, sulphamic acid, phenolsulphonic acid and methanesulphonic acid.

$R_1$ and $R_2$ (which may be the same or different)=R, H or optionally substituted alkyl.

Especially preferable examples include:

(a)

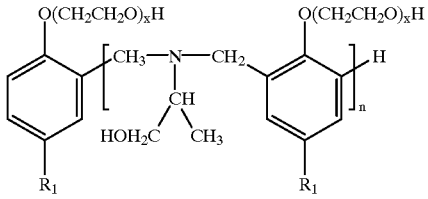

wherein $R_1$ = $CH_3$, $CH_2CH_3$, $CH(CH_3)_2$ or $C(CH_3)_3$; n = 1–7, X = 0–10

(b)

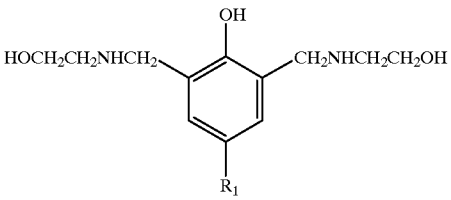

$R_1$ = $CH_3$, $CH_2CH_3$, $CH(CH_3)_2$, or $C(CH_3)_3$

-continued (c)

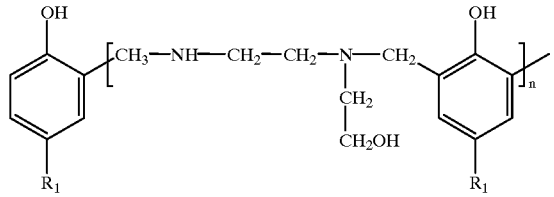

wherein $R_1$ = $CH_3$, $CH_2CH_3$, $CH(CH_3)_2$ or $C(CH_3)_3$; n = 1–7

(d)

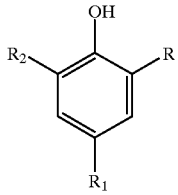

R—$CH_2NHCH_2CH_2NHCH_2CH_2OH$ $R^1$—$CH_3$, —$CH_2CH_3$ or —$C(CH_3)_3$ $R^2$ = H or R

As will be known to those skilled in the art such additives can conveniently be made by condensation of the phenol with an aldehyde and an amine under acidic or basic conditions. The molar proportions of phenol to amine to aldehyde may be varied over a wide range typically the range will be from 1:1:1 to 1:2:2. As will be obvious to those skilled in the art such a reaction will give rise to a mixture of monomeric and polymeric products. The reaction products may also be alkoxylated with either ethylene or propylene oxide. Although any phenol, amine and aldehyde may be used preferred examples include:

Phenols: ortho and/or para alkyl-phenols, where the alkyl group is methyl, ethyl, isopropyl, n-butyl, sec-butyl, tert-butyl, isoamyl, hexyl, and nonyl; Diphenols: 2,2-bis(4-hydroxyphenyl)propane or 4,4'-dihydroxydiphenylsulphone.

Aldehydes: formaldehyde, acetaldehyde, glyoxal.

Amines: methylamine, dimethylamine, ethylamine, diethylamine, n- or iso-propylamine, n- or sec-butylamine, n-hexylamine, ethanolamine, diethanolamine, n or iso-propanolamine, 2-aminobutanol, 4-aminobutanol, 2-amino-5-diethylaminopentane, 2-(2-aminoethoxy)ethanol, 2-(2-aminoethylamino)ethanol, 2-amino-2-ethyl-1,3-propandiol.

The compositions of the present invention when used for tin plating provides a wider plating range and brighter plates with less surface defects than can be obtained by using other addition agents.

The surfaces which can be tin-plated using the compositions and methods of the invention are those surfaces which may normally be tin-plated e.g. steel or copper. The plated surfaces include those of strips and wires and the applicable processes include those involving the plating of strips and wires.

EXAMPLES

Example 1

This example illustrates how the preferred addition agents may be synthesised using base catalysis.

Substituted phenol (1 mole), water (equivalent weight based on phenol) and sodium hydroxide (0.2 mole) were charged to the reactor. The mixture was heated at 60° C. with agitation until a clear solution was obtained.

Amine (2 moles) was charged into a second reactor and aldehyde (2 moles) slowly added with stirring whilst keeping the temperature below 60° C. This solution was added to the alkylphenol solution in this first reactor and the mixture heated at 100° C. for half an hour.

The following examples are illustrative of this method of synthesis.

TABLE 1

| Example Number | Phenol | Amine | Aldehyde |
|---|---|---|---|
| 2 | 4-Methylphenol | Ethanolamine | Formaldehyde |
| 3 | 4-tert Butylphenol | 2-(2-aminoethylamino) ethanol | Formaldehyde |
| 4 | 4,4'-Isopropylidene-diphenol | Diethanolamine | Formaldehyde |
| 5 | 4-Ethylphenol | iso-Propanolamine | Formaldehyde |
| 6 | 4-tert Butylphenol | Diethanolamine | Formaldehyde |
| 7 | 4-tert Butylphenol | Ethanolamine | Formaldehyde |
| 8 | 3-Methylphenol | Ethanolamine | Glyoxal |
| 9 | 4-nonylphenol 7 mole ethoxylate | Ethanolamine | Formaldehyde |
| 10 | 4-tert Butylphenol 1 mole ethoxylate | 2-amino-2-ethyl-propane-diol | Formaldehyde |

Example 11

This example illustrates how the preferred addition agents may be made using acid catalysis.

Formaldehyde (2 moles) was slowly added to ethanolamine (2 moles) with stirring, the temperature being kept to below 60° C. Water (108 g) was added and the mixture acidified to pH 3 using sulphuric acid. The mixture was heated to 60° C. and p-cresol (1 mole) added, on completion of the addition the mixture was heated to 100° C. for 30 mins and then cooled.

The electroplating characteristics of various compositions were determined in a Hull Cell at 3 amps total current for 1 minute at 50° C. A 10 cm×6 cm steel plate, pre-cleaned by immersion in sodium hydroxide followed by a water rinse and immersion in 18.5% hydrochloric acid, was used in all the following examples.

The aqueous compositions used are out in Table 2, Examples 12–22 are according to the invention whilst Examples 23 and 24 are provided for comparison.

In examples 12 and 14 to 21 the composition included 1 g/l of antioxidant (1,2-dihydroxybenzene-4-sulphonic acid). The tin source in all cases was tin sulphate in an amount of 30 g/l calculated as $Sn^{++}$.

TABLE 2

| Example No. | Acid | Acid conc. (g/l) | Addition Agent (as per example) | Addition Agent conc. (g/l) | Plating Range ($A/dm^2$) × 10 |
|---|---|---|---|---|---|
| 12 | Sulphuric | 60 | (4) | 6 | 15–67 |
| 13 | PSA | 60 | (5) | 6 | 5.4–90 |
| 14 | PTSA/Sulphamic | 10/50 | 9 parts (2) + 1 part (3) | 6 | 6.5–90 |
| 15 | PTSA/Sulphuric | 40/50 | (11) | 6 | 5.4–37 |
| 16 | Benzenesulphonic | 60 | 1 part (2) + 1 part (6) | 6 | 10–55 |
| 17 | Sulphuric | 50 | (8) | 6 | 11–82 |
| 18 | Methanesulphonic | 60 | (7) | 6 | 5.4–38 |
| 19 | Methanesulphonic | 50 | (9) | 3 | 6–58 |
| 20 | PTSA/Sulphuric | 10/40 | 8 parts (3) + 2 parts (9) | 5 | 5.4–70 |
| 21 | PTSA/Sulphuric | 10/50 | 9 parts (2) + 1 part (9) | 6 | 5.4–90 |
| 22 | PSA | 40 | (10) | 6 | 11–74 |
| 23 | PSA | 60 | ENSA 6 | 4 | 9–54 |
| 24 | PSA | 60 | Diphane V | 6 | 7–52 |

All concentrations are in g/l of the composition including the water.

PSA is phenol sulphonic acid.

PTSA is para toluene sulphonic acid.

What is claimed is:

1. A composition suitable for use in a process for electroplating surfaces with tin, comprising a) one or more acids selected from the group consisting of sulphuric acid, sulphamic acid, phenol-4-sulphonic acid; toluene-2 sulphonic acid, toluene4-sulphonic acid, and methane sulphonic acid;

b) one or more addition agents selected from the group consisting of a 2,4-di-substituted phenol, a 2,6-di-substituted phenol, and a 2,4,6-tri-substituted phenol and the alkyolated forms thereof in which at least one of the substituents includes a secondary, tertiary or quaternary nitrogen atom, c) a tin source and d) water.

2. A composition as claimed in claim 1, wherein the tin source is a tin salt.

3. A composition as claimed in claim 1, wherein the acid or acids are present in a total concentration of 25–500 g/l of the composition.

4. A composition as claimed in claim 3, wherein the acid or acids are present in a concentration of 30–250 g/l.

5. A composition as claimed in claim 4, wherein the acid or acids are present in a concentration of 30–100 g/l.

6. A composition as claimed in claim 1, wherein the tin source is present in the composition at a concentration of 5–100 g/l, with respect to the composition.

7. A composition as claimed in claim 6, wherein the tin source is present in an amount of 15 to 60 g/l.

8. A composition as claimed in any one of the preceding claims, which also comprises an antioxidant.

9. A composition as claimed in claim 8, wherein the antioxidant is present in an amount of 1 to 50 g/l of the composition.

10. A composition as claimed in claim 9, wherein the antioxidant is present in an amount of from 2.5 to 20 g/l of the composition.

11. A composition suitable for use in a process for electroplating surfaces with tin, comprising a) one or more acids selected from the group consisting of sulphuric acid, sulphamic acid, aryl sulphonic acids, alkyl sulphonic acids and alkanol sulphonic acids, b) one or more addition agents, c) a tin source and d) water, wherein the one or more addition agent is selected from compounds of the general formula:

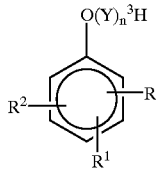

in which:

$R^1$ and $R^2$=R, H, alkyl or substituted alkyl and may be the same or different, Y=alkylene, $CH_2CH_2O$ or $CH(CH_3)CH_2O$ $n^3$=0–10

$n^3$=1 when Y=alkylene

R=a group of formula:

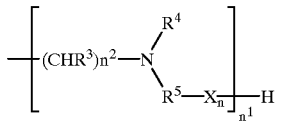

in which:

$R^3$=H, alkyl, aryl, hydroxyl or CHO, with the proviso that when $R^3$ is hydroxyl or CHO, $n^2$=1–3, and when $R^3$ is H, alkyl or aryl, $n^2$ is 1, $R^4$=H, alkyl, cycloalkyl, hydroxyalkyl or alkoxyalkyl, $R^5$=alkyl, optionally interrupted by O or N atoms, which may be further substituted, X=a phenol or an alkoxylated phenol radical, optionally further substituted, n=0 or 1

$n^1$=1 to 7 when n=0, $n^1$=1 when n=1, $n^1$=1–7, or

R is in the form of its a quaternary ammonium salt formed by reaction with sulphuric acid, toluenesulphonic acid, sulphamic acid, phenolsulphonic acid or methanesulphonic acid.

12. A method of tin plating a surface which comprises using a composition as claimed in claim 1 or 11.

13. A method as claimed in claim 12, wherein said proccess is a strip or wire plating process.

14. A composition as claimed in claim 11, wherein the one or more addition agent is selected from the group consisting of formula (a), formula (b), formula (c) and formula (d) as defined below:

(a)

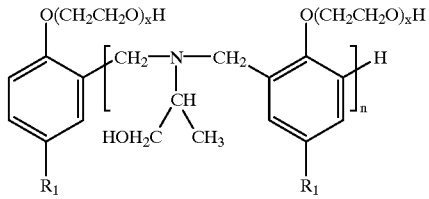

wherein $R_1$ is $CH_3$, $CH_2CH_3$, $CH(CH_3)_2$ or $C(CH_3)_3$; n=1–7; and x=0–10;

(b)

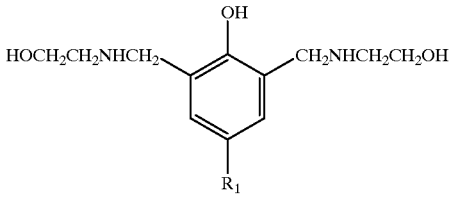

wherein $R_1$=$CH_3CH_2CH_3$, $CH(CH_3)_2$ or $C(CH_3)_3$;

(c)

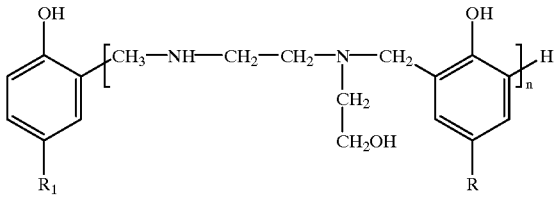

wherein $R_1$ is $CH_3$, $CH_2CH_3$, $CH(CH_3)_2$ or $C(CH_3)_3$ and n=1–7; and $_3$(d)

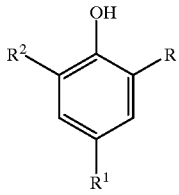

wherein R is —$CH_2NHCH_2CH_2NHCH_2CH_2OH$; $R^1$ is $CH_3$, $CH_2CH_3$ or $C(CH_3)_3$ and $R^2$ is H or is R.

* * * * *